US008385798B2

(12) United States Patent
Funabiki et al.

(10) Patent No.: US 8,385,798 B2
(45) Date of Patent: Feb. 26, 2013

(54) FIXING DEVICE AND IMAGE FORMING APPARATUS

(75) Inventors: Hiroshi Funabiki, Uenohara (JP); Masanori Murakami, Hachioji (JP); Jinju Okuno, Hino (JP); Koji Yamamoto, Toyokawa (JP)

(73) Assignee: Konica Minolta Business Technologies, Inc. (JP)

( * ) Notice: Subject to any disclaimer, the term of this patent is extended or adjusted under 35 U.S.C. 154(b) by 262 days.

(21) Appl. No.: 12/850,396

(22) Filed: Aug. 4, 2010

(65) Prior Publication Data

US 2011/0033214 A1 Feb. 10, 2011

(30) Foreign Application Priority Data

Aug. 7, 2009 (JP) ..... 2009-184296

(51) Int. Cl.
*G03G 15/20* (2006.01)

(52) U.S. Cl. ..... 399/323

(58) Field of Classification Search ..... 399/323, 399/398

See application file for complete search history.

(56) References Cited

U.S. PATENT DOCUMENTS

| | | | | |
|---|---|---|---|---|
| 7,062,211 | B2 * | 6/2006 | Baba et al. | 399/323 |
| 2007/0147912 | A1 * | 6/2007 | Fujii | 399/323 |

FOREIGN PATENT DOCUMENTS

| | | | |
|---|---|---|---|
| JP | 60-247672 | A | 12/1985 |
| JP | 60-256180 | A | 12/1985 |
| JP | 61-62087 | A | 3/1986 |
| JP | 63-140571 | U | 9/1988 |
| JP | 8-54801 | A | 2/1996 |
| JP | 2004-212954 | A | 7/2004 |
| JP | 2005-128333 | A | 5/2005 |
| JP | 2007-86132 | A | 4/2007 |
| JP | 2007-178732 | A | 7/2007 |
| JP | 2007-206153 | A | 8/2007 |
| JP | 2007-233228 | A | 9/2007 |
| JP | 2007-240921 | A | 9/2007 |

* cited by examiner

*Primary Examiner* — David Gray
*Assistant Examiner* — Gregory H Curran
(74) *Attorney, Agent, or Firm* — Cantor Colburn LLP

(57) ABSTRACT

A fixing device including: a fixing member; a pressing member to form a nip portion between the pressing member and the fixing member, wherein the fixing member and the pressing member sandwich a recording medium, fix a toner image on the recording medium and convey the recording medium; a detection unit for detecting that a leading edge of the recording medium is located at the nip portion; a first air jetting unit for separating the recording medium from the fixing member by jetting air only to a position close to the leading edge of the recording medium having passed the nip portion based on the detection result by the detection unit; and a second jetting unit for jetting air to the recording medium whose leading edge has passed through the nip portion.

16 Claims, 5 Drawing Sheets

FIXING DEVICE AND IMAGE FORMING APPARATUS

This application is based on Japanese Patent Application No. 2009-184296 filed on Aug. 7, 2009 in Japanese Patent Office, the entire content of which is hereby incorporated by reference.

BACKGROUND

1. Field of the Invention

The present invention relates to a fixing device for fixing a toner image on the recording medium using the nip portion formed by a fixing member and pressure member.

2. Description of Related Art

In an image forming apparatus using an electrophotographic process such as a photocopier, printer, facsimile and multi-functional peripheral having the functions of these devices, the latent image corresponding to a document is formed on a photoreceptor, and toner is applied to this latent image, whereby the image is developed. The developed toner image is transferred onto a recording sheet. After that, the toner image transferred onto the recording sheet is fixed and the sheet is ejected.

One of the fixing devices for fixing a toner image in the aforementioned manner includes a fixing device based on the heat roller fixing method, wherein the recording sheet with the toner image transferred thereto is sandwiched and transferred, using a nip portion formed between a fixing roller with a halogen heater built therein, and a pressure roller for applying pressure to the fixing roller, and, at the same time, this recording sheet is exposed to heat and pressure. Such a fixing device has been employed over an extensive range because of the simple structure.

Another example of the aforementioned fixing devices is a fixing device of the belt fixing method, wherein an endless fixing belt is applied to a heating roller with a halogen heater or the like built therein and a fixing roller, the aforementioned fixing device being provided with a pressure roller for applying pressure to the fixing roller through the fixing belt, and the recording sheet with toner image transferred thereto is sandwiched and transferred, using a nip portion formed between the fixing roller and pressure roller, while the aforementioned recording sheet is exposed to heat and pressure at the same time. Such a fixing device characterized by a smaller thermal capacity of the fixing belt reduces warm-up time and saves power.

In this case, the toner of the toner image on the recording sheet is heated in the process of passing through the nip portion. Thus, the toner acts as an adhesive; therefore, the recording sheet having passed through the nip portion sticks to the surface of the fixing roller and fixing belt and winds around the same without getting separated. This may cause a paper jam to occur Separability is further reduced when a sheet of a smaller basis weight (thin paper), particularly when the coated paper of reduced basis weight for printing is used as a recording sheet.

In the meantime, if the fixing roller is increased to ensure a nip width of sufficient size to cope with the increasing speed of the image forming apparatus, the roller curvature at the fixing nip outlet is reduced, with the result that sheet separability is further reduced.

To facilitate separation of the recording sheet from the fixing member, various measures have been taken. For example, the surface layer of the fixing member is made of a heat-resistant resin with high release characteristics, or is coated with a mold releasing agent such as silicone oil. Alternatively, the toner is impregnated with the wax that acts as a mold releasing agent when made molten by heat. However, there have been a growing number of factors for reducing the separability, including formation of an image on the coated paper, and an increase in the toner adhesive power caused by an increasing amount of toner due to the need of overlapping the toners of a plurality of colors for forming a color image. This makes it essential to use a separation assisting device.

In one of the means for assisting separation, a separation claw coated with fluorine resin characterized by excellent release characteristics is provided on the side of rejecting the recording sheet for the nip portion, and the leading edge thereof is brought in contact with the outer surface of the fixing roller or fixing belt, whereby the recording sheet is separated from the fixing roller and others.

However, the leading edge of the separation claw is in contact with the surface of the fixing roller or others. Accordingly, the surface layer formed of the fluorine resin and others coating the fixing roller and others is scratched, and the scratch is transferred to the image. This problem tends to be serious since a glossy image is required especially in the case of a color image.

One of solutions to this problem is a technique wherein air is blown on the outside side of the nip portion to separate the recording sheet from the fixing roller and others.

One example of this technique is found in a sheet separation device wherein compressed air provided by a compressor is stored in two air boxes, and two electromagnetic valves connected to the air boxes are alternately turned on and off so as to jet compressed air and to meet the requirements of a high-speed photocopier (Unexamined Japanese Patent Application Publication No. Sho 60 (1985)-256180).

Another example is a fixing device wherein a separation claw (separation claw) is provided and the air fed by a fan is blown on the nip portion (Japanese Utility Model Laid-Open No. Sho 63 (1988)-140571).

Further, another known example is a separation device wherein a separation assisting plate is arranged close to the nip portion and spiral-formed compressed air is jetted out from between the fixing roller and separation assisting plate (Unexamined Japanese Patent Application Publication No. 2004-212954).

Another known example is a fixing device wherein the compressed air produced from a compressor is jetted out by two electromagnetic valves and high-pressure compressed air is jetted when the leading edge of the recording sheet has passed through the nip portion. After that, the compressed air of lower pressure is blown thereafter (Unexamined Japanese Patent Application Publication No. 2007-86132).

When air is blown so that the fixed recording sheet will not stick to the fixing roller or others, and the recording sheet is separated from the fixing roller, the effect is influenced by the area of the portion on which air is blown. If no toner image is formed close to the leading edge of the recording sheet and there is a wide area free from adhesive force, the leading edge of the recording sheet is separated by the toughness and weight of the recording sheet, and air is received by the separated area. This provides a greater separation force. However, when a toner image has been formed up to the leading edge of the recording sheet, the recording sheet is conveyed in the direction tangential to the outer periphery of the fixing roller and others. This minimizes the clearance between the leading edge of the recording sheet and the outer periphery of the fixing roller and others. For example, when the outer diameter of the fixing roller is 90 mm and the margin of the leading edge of the recording sheet is 3 mm, the clearance is only 0.1 mm. To blow air into this clearance and to lift the leading edge of the recording sheet, it is necessary to blow air at a high velocity, namely, high pressure air to the nip portion. To achieve this, it is preferred to use the high-pressure compressed air produced from a compressor.

The recording sheet having passed through the nip portion sticks to the surface of the fixing roller or fixing belt and winds around the same without being separated. This phenomenon occurs not only at the leading edge of the recording sheet but also after the leading edge. Further, even if the leading edge of the recording sheet is pulled out by the sheet ejection roller, irregular separation occurs at the wound portion. Accordingly, when air is blown on the outlet side of the nip portion to separate the recording sheet from the fixing roller and others, air must be blown on a continuous basis.

If compressed air is blown on a continuous basis in this manner, compressed air close to 0.01 $m^3/s$ will be required. A great amount of energy is required to produce compressed air. To produce the compressed air of this air volume, a large-power compressor with a capacity of 5 to 10 kW must be used. The size of the device including a compressor and air tank may reach a high level of about 1 $m^3$.

In the conventional literatures, it is difficult to find a structure that meets the related performances without allowing the size of the device to increase.

To be more specific, the Unexamined Japanese Patent Application Publication No. Sho 60 (1985)-256180 may result in producing a large-sized device including a large-power compressor, as described above.

The Japanese Utility Model Laid-Open No. Sho 63 (1988)-140571 uses the air fed by a fan. In this case, the high pressure air cannot be obtained, and use of a combination with a separation claw is inevitable. Accordingly, the surface layer of the fixing roller will be scratched by the separation claw. This problem has not been solved.

In the Unexamined Japanese Patent Application Publication No. 2004-212954, after the leading edge of the recording sheet has been removed by compressed air, the recording sheet is separated by a sharp separation assisting plate. This may cause the image of the recording sheet to be scratched.

In the Unexamined Japanese Patent Application Publication No. 2007-86132, after the leading edge of the recording sheet has been removed by compressed air, the pressure of the compressed air is reduced. However, to maintain separability, a sufficient amount of air is required. To ensure this amount of air, a large-sized device equipped with a large-power compressor will have to be produced, as described above.

In view of the problems described above, it is an object of the present invention to provide a fixing device and an image forming apparatus provided with this fixing device, wherein this fixing device separates the leading edge of a recording sheet by compressed air, without having to use a large-power compressor or allowing the device to be increased in size.

SUMMARY

To achieve at least one of the above mentioned objects, a fixing device reflecting one aspect of the present invention comprises: a fixing member; a pressing member to form a nip portion between the pressing member and the fixing member, wherein the fixing member and the pressing member sandwich a recording medium, fix a toner image on the recording medium and convey the recording medium; a detection unit for detecting that a leading edge of the recording medium is located at the nip portion; a first air jetting unit for separating the recording medium from the fixing member by jetting air only to a position close to the leading edge of the recording medium having passed the nip portion based on the detection result by the detection unit; and a second jetting unit for jetting air to the recording medium whose leading edge has passed through the nip portion.

In the fixing device, preferably a velocity of air jetted from the first air jetting unit is greater than a velocity of air jetted from the second air jetting unit.

In the fixing device, preferably a sectional area of the first air jetting unit is smaller than that of the second air jetting unit.

In the fixing device, preferably an electromagnetic valve is provided between an air supply unit for the first air jetting unit and the first air jetting unit.

In the fixing device, preferably the air supply unit for the first air jetting unit is an air compressor, and an air supply unit for the second air jetting unit is a fan or blower.

In the fixing device, preferably a plurality of the first air jetting units and a plurality of the second air jetting units are arranged along a width of the recording medium to be fixed; and the fixing device is provided with a control unit wherein, when fixing the recording medium narrower than the widest recording medium that can be fixed, control is provided in such a way as to suspend a jetting of air from the first and second air jetting units which are located at the end across the recording medium and which do not contribute to separation of the recording medium.

The fixing device, preferably further comprises a plurality of electromagnetic valves communicating with the first air jetting units respectively, and a plurality of fan switches communicating with the second air jetting units, wherein the control unit controls on-off operations of the electromagnetic valves and fan switches.

DETAILED DESCRIPTION OF THE PREFERRED EMBODIMENT

Figure 1:
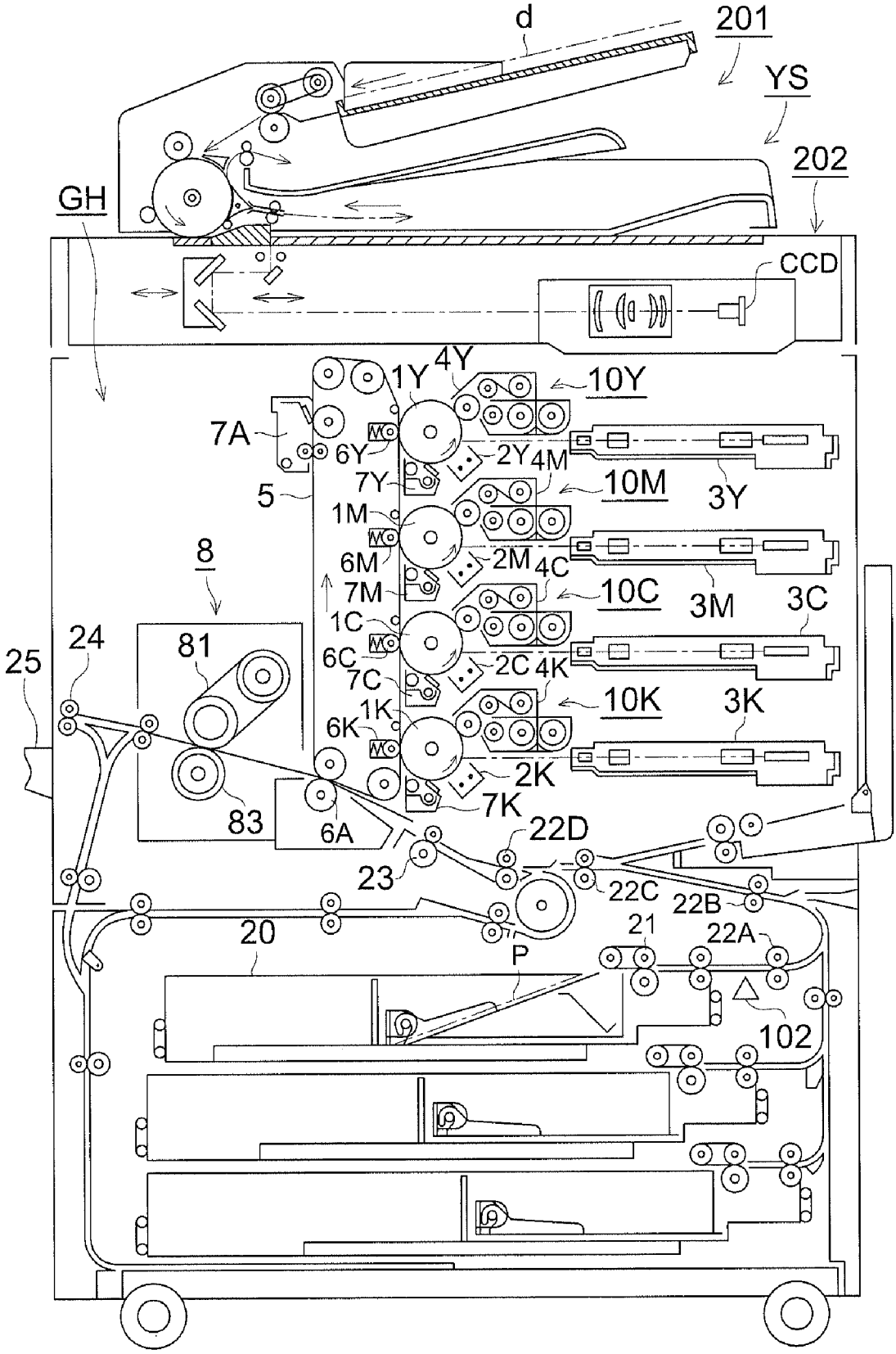
FIG. 1 is a schematic diagram representing an image reading device.

The following describes the embodiments of the present invention with reference to the drawings.

In the first place, an example of the image forming apparatus using the present invention will be described with reference to FIG. 1.

This image forming apparatus includes an image forming apparatus main unit GH and an image reading device YS.

The image forming apparatus main unit GH is called the tandem color image forming apparatus, and includes a plurality of image forming sections 10Y, 10M, 10C and 10K, belt-shaped intermediate transfer belt 5, sheet feed and conveying unit and belt conveying device 8.

The top of the image forming apparatus main unit GH is provided with an image reading device YS including an automatic document feed device 201 and document image scanning exposure device 202. The document d placed on the document platen of the automatic document feed device 201 is conveyed by the conveying unit. The image on one or both surfaces of the document is subjected to scanning and exposure by the optical system of the document image scanning exposure device 202, and is read into the line image sensor CCD.

The signal formed by photoelectric conversion through the line image sensor CCD is subjected to analog processing, analog-to-digital conversion, shading correction and image compression in the image processing section, and is sent to the exposure units 3Y, 3M, 3C and 3K.

The image forming sections 10Y forming a yellow (Y) image has a charging unit 2Y, exposure unit 3Y, development unit 4Y and cleaning unit 7Y arranged around the photoreceptor drum 1Y. The image forming sections 10M forming a magenta (M) image has a charging unit 2M, exposure unit 3M, development unit 4M and cleaning unit 7M arranged around the photoreceptor drum 1M. The image forming sections 10C forming a cyan (C) image has a charging unit 2C, exposure unit 3C, development unit 4C and cleaning unit 70 arranged around the photoreceptor drum 1C. The image forming sections 10K forming a black (K) image has a charging unit 2K, exposure unit 3K, development unit 4K and cleaning unit 7K arranged around the photoreceptor drum 1K. Latent image forming units are formed by a charging unit 2Y and exposure unit 3Y, a charging unit 2M and exposure unit 3M, a charging unit 2C and exposure device 3C, and a charging unit 2K and exposure device 3K.

The development units 4Y, 4M, 4C and 4K includes the two-component developer made of yellow (Y), magenta (M), cyan (C) and black (K) toners having a small particle diameter, and carriers. The toner is made of pigment or dye serving as a coloring reagent, a wax helping separation of toner from the fixing member after fixing, and a binder resin for holding them together.

The intermediate transfer belt 5 is driven by a plurality of rollers and is supported rotatably.

The fixing device 8 allows the toner image of the recording sheet (recording medium) P to be heated and pressed by the nip portion formed between the heated fixing belt 81 and pressure roller 83, whereby the toner image is fixed in position.

Thus, images of different colors formed by the image forming sections 10Y, 10M, 10C and 10K are sequentially transferred onto the rotating intermediate transfer belt 5 by the transfer units 6Y, 6M, 6C and 6K (primary transfer), and a composite color toner image is created. The recording sheet P stored in the sheet feed cassette 20 is fed by the sheet feed unit 21, and is conveyed to the transfer unit 6A through the sheet feed rollers 22A, 22B, 22C and 22D, registration roller 23 and others. Then the color image is transferred onto the recording sheet P (secondary transfer). The recording sheet P with the color image transferred thereon is heated and pressed by the fixing device 8, and the color toner image of the recording sheet P is fixed. After that, the sheet is sandwiched by the sheet ejection roller 24 and is placed on the sheet ejection tray 25 placed outside the apparatus.

In the meantime, after the color image has been transferred to the recording sheet P by the transfer unit 6A, the recording sheet P is subjected to curvature-separation from the intermediate transfer belt 5. Then the toner is removed from the intermediate transfer belt 5 by a cleaning unit 7A.

The image forming apparatus for color image formation has been described so far. However, it can be an image forming apparatus for forming a monochromatic image, and the intermediate transfer belt need not be used.

Figure 2:
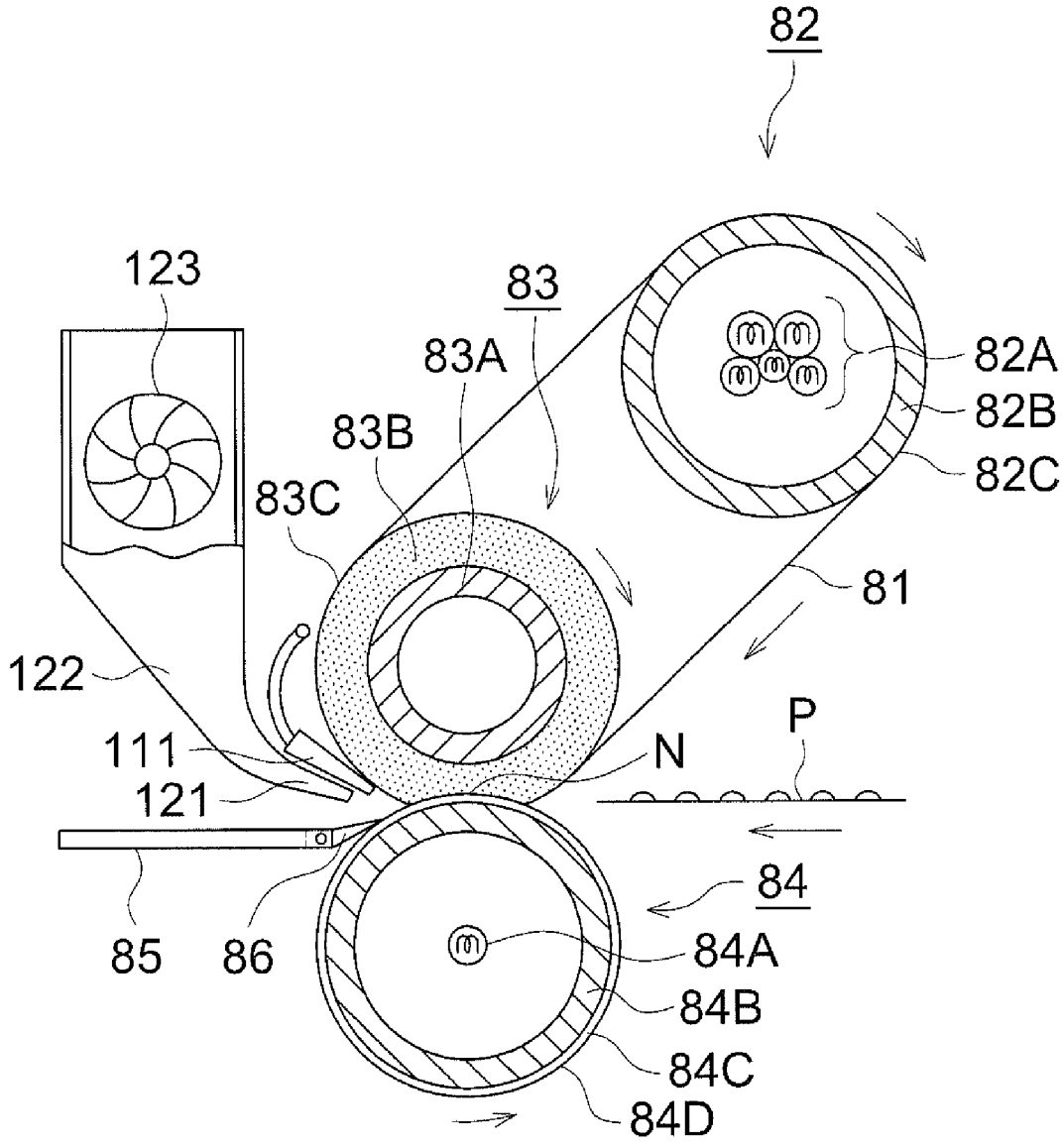
FIG. 2 is a cross sectional view showing a belt fixing device.

The following describes the fixing device 8 of the present invention with reference to the cross sectional view of FIG. 2.

The fixing belt 81 (fixing member) is formed in an endless structure. For example, the basic structure is made of PI (polyimide) having a thickness of 70 μm. The outer peripheral surface of the basic structure is coated with a heat resistant silicone rubber (hardness JIS-A15°) having a thickness of 200 μm, which is further covered with a tube made of heat-resistant resin PFA (perfluoroalkoxy) having a thickness of 30 μm. The outer diameter is 170 mm, for example. It is also possible to use other structures. For example, the basic structure can be a metal produced by nickel electroforming. A fluorine rubber can be used as an elastic layer. The surface mold releasing layer can be formed of a layer coated with fluorine resin including the PFA or PTFE (polytetrafluoroethylene).

The heating roller 82 incorporates a halogen heater 82A as a heating unit for heating the fixing belt 81. For example, the outer peripheral surface of the cylindrical core metal 82B having a thickness of 4 mm formed of aluminum and others is covered with the resin layer 82*c* coated with PTFE having a thickness of 30 μm. The outer diameter is 90 mm, for example. To conform to various sheet widths, the halogen heaters 82A consist of two 1200-watt heaters, two 750-watt heaters and one 500-watt heater, for example, and are arranged to ensure different heat generation distribution in the axial direction to conform to various widths of the recording sheets.

The fixing roller 83 includes a solid core metal 83A, which is as an elastic layer 83B formed of a metal such as iron. This core metal is coated with a heat resistant silicone rubber (hardness JIS-A10°) having a thickness of 17 mm. This is further covered with a resin layer 83C coated with a low-friction and heat-resistant resin having a thickness of 30 μm. The outer diameter is 90 mm, for example.

The pressure roller 84 (pressure member) incorporates a halogen heater 84A to reduce the time for temperature rise immediately after the power is turned on. The outer peripheral surface of the cylindrical core metal 84B having a thickness of 4 mm formed of aluminum and others is covered with a heat resistant silicone rubber (hardness JIS-A10°) having a thickness of 2 mm as an elastic layer 84C. This is further coated with a resin layer 84D of a PFA tube having a thickness of 30 μm. The outer diameter is 90 mm, and the halogen heater 84A has a 700-watt power supply, for example.

The pressure roller 84 uses a biasing unit (not illustrated) to press the fixing roller 83 through the fixing belt 81.

In the aforementioned structure, when the pressure roller 84 is turned in the counterclockwise direction by a drive unit (not illustrated), the fixing belt 81 and heating roller 82 are turned in the clockwise direction. The fixing roller 83 is also turned in the clockwise direction. The fixing roller 83 can also be driven. Further, the fixing belt 81 is heated by the halogen heater 82A through the heating roller 82 in contact and the pressure roller 84 is also heated by the halogen heater 84A. The pressure roller 84 is biased in the direction of the fixing roller 83 by the biasing unit (not illustrated). Accordingly, the recording medium P having been fed is heated and pressed at the nip portion N formed between the fixing belt 81 and pressure roller 84 driven by the fixing roller 83, whereby a toner image is fixed on the recording medium P.

The following describes the fixing conditions.

Fixing load: 2000 N

Fixing belt tension: 250 N

Fixing belt control temperature: 160 through 200° C.

Pressure roller control temperature: 80 through 120° C.

Recording sheet conveying speed: 500 mm/s

Any desired heating unit can be used as a heating unit for heating the fixing belt 81. For example, it is possible to employ an inductive heating element using an exciting coil.

Further, the heating unit installation site is not restricted to the position inside the heating roller 82.

It is also possible to provide a tension roller to provide the fixing belt 81 with tension, or a belt offset control roller to control meandering of the belt.

In the aforementioned fixing device 8, the fixed recording medium P is ejected from the nip portion N. If the fixed recording medium P sticks to the fixing belt 81 and winds around this belt, a paper jam may occur. To avoid this, it is essential to separate the recording medium P completely from the fixing belt 81.

In this fixing device 8, a first air nozzle 111 (first air jetting unit) and second air nozzle 121 (second air jetting unit) are provided as separation units close to the outlet of the nip portion N. The first air nozzle 111 is used to jetting compressed air produced by the compression of a compressor. Air is blown for a short time on the leading edge of the recording sheet P immediately after having passed through the nip portion N so that the leading edge of the recording sheet P is separated from the fixing belt 81. In the meantime, the second air nozzle 121 continuously jets air provided by the fan or blower. This air is blown on the recording sheet P whose leading edge has been separated, to ensure that the separated recording sheet P will not stick to the fixing belt 81.

The sectional area of the first air nozzle 111 is formed smaller than that of the second air nozzle 121.

As described above, the recording sheet P separated from the fixing belt 81 is guided and conveyed by the sheet ejection guide plate 85. Since the separation claw 86 formed of heat resistant resin is in contact with the pressure roller 84, the recording sheet P does not wind around the pressure roller 84, even if the recording sheet P is pressed downward by the air fed from the first air nozzle 111 or the second air nozzle 121. In the separation claw 86, the leading edge, for example, is coated with about 10 mm of fluorine resin. This ensures excellent lubricity. Further, it is in contact with the pressure roller 84 at a low pressure of about 1 mN. This arrangement prevents the pressure roller 84 from being scratched. In addition, even if a toner image is located closer to the pressure roller 84 in the duplex copying mode, the toner image is not molten because the temperature of the pressure roller 84 is low. Further, the image is not damaged by the separation claw 86.

To maintain the low temperature of the pressure roller 84, the space interval between the transfer unit 6A and fixing device 8 is set at a level greater than the maximum length of the recording sheet P. At the same time, this space reduces the distance between sheets. This arrangement reduces heat transfer from the fixing belt 81 to the pressure roller 84. Further, the inner periphery and outer periphery of the pressure roller 84 can be cooled by a fan.

Further, a separation claw used in the conventional fixing device can be used as the separation claw 86.

Figure 3:
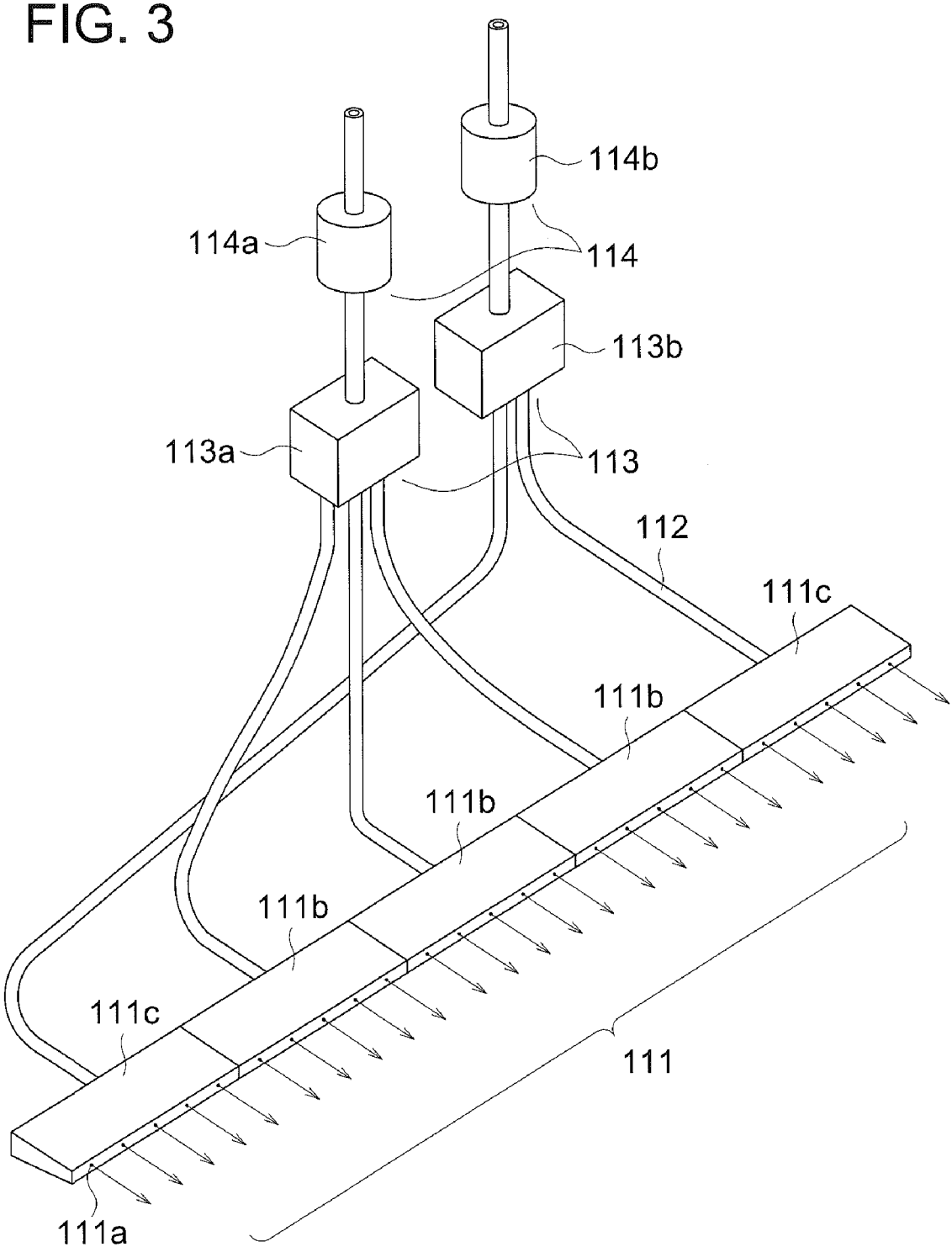
FIG. 3 is a perspective view showing a first air nozzle, electromagnetic valve and others.
Figure 4:
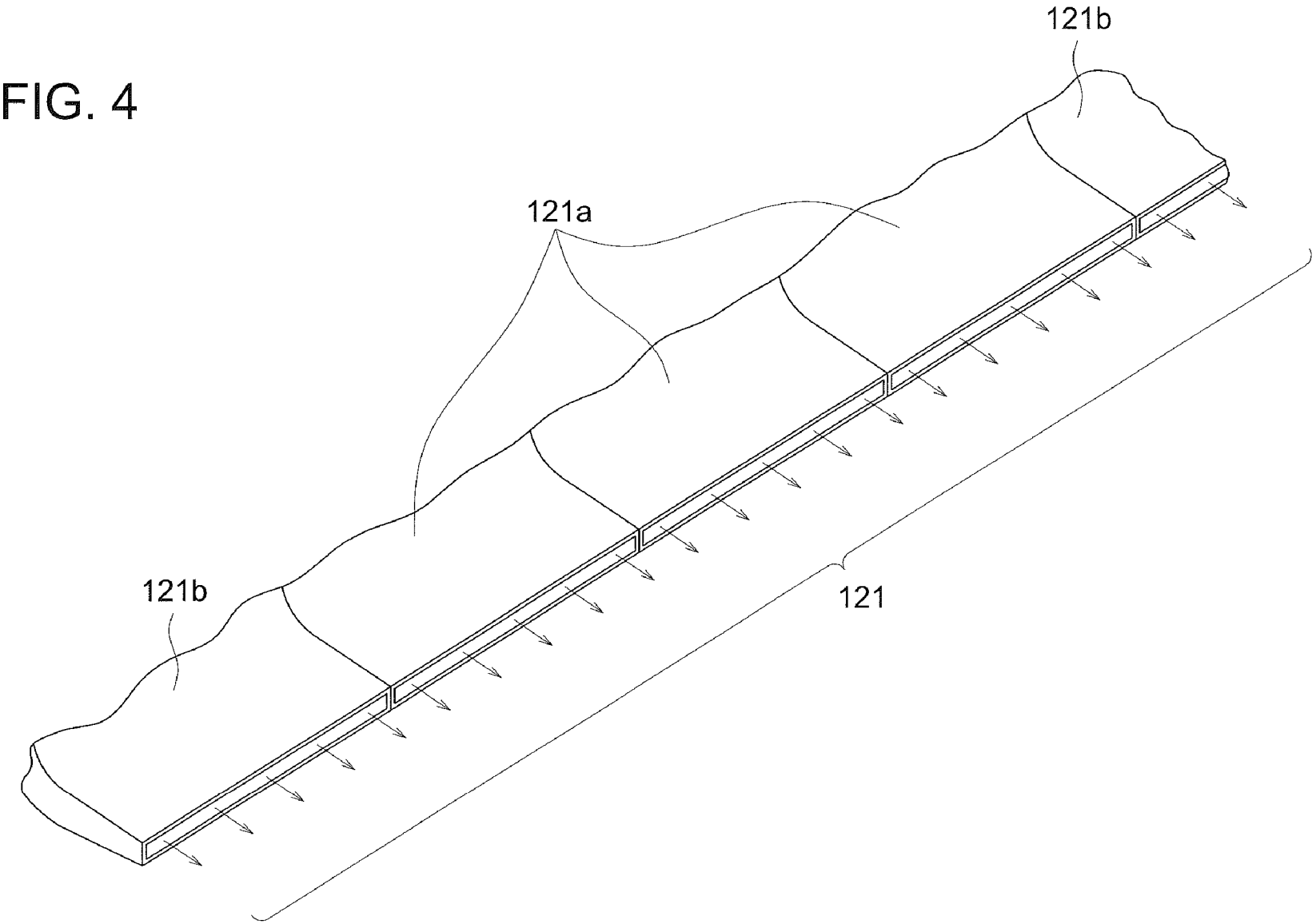
FIG. 4 is a perspective view showing a second air nozzle.
Figure 5:
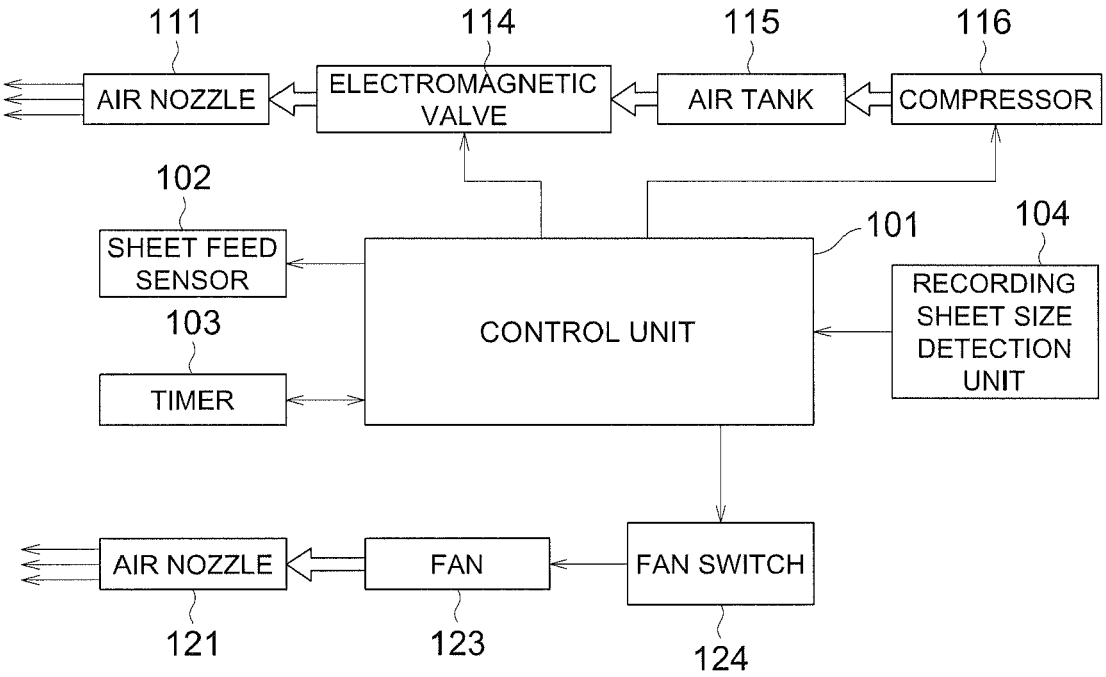
FIG. 5 is a block diagram for the control of a compressor and a fan.

Referring to FIGS. 3 through 5, the structure of discharging air from the first air nozzle 111 and the second air nozzle 121 is explained. FIG. 3 is a perspective view showing a first air nozzle 111, electromagnetic valve and others. FIG. 4 is a perspective view showing a second air nozzle 121. FIG. 5 is a block diagram for the control of a compressor and a fan.

In the first place, the structure of the first air nozzle 111 and related parts will be described with reference to FIGS. 3 and 5.

In FIG. 3, five first air nozzles 111 are provided across the recording sheet P. Each of the first air nozzles 111 is provided with 13 nozzle holes 111*a* having a diameter of 1 mm at a pitch of 5 mm. Thus, the total number of the nozzle holes 111*a* is 65 for the five first air nozzles 111. The nozzle holes 111*a* function as outlets of the first jetting unit. The nozzle hole 111*a* is located, for example, 25 mm away from the outlet of the nip portion N. The extension line thereof is arranged to be oriented toward the outer peripheral surface of the fixing belt 81 at positions from 5 through 10 mm from the outlet of the nip portion N.

The five first air nozzles 111 are connected to two piping sections 113 by five pipes 112 each. Two piping sections 113 communicate with two electromagnetic valves 114, respectively. Although the portion forward of the electromagnetic valve 114 is not illustrated, the electromagnetic valve 114 is connected to the air tank 115 of FIG. 5 and integrated thereto. The air tank 115 as an air supply unit is connected to the compressor 116 (air compressor).

The electromagnetic valve 114 is a directly acting valve with a capacity of 0.002 $m^3/s$ (100 kPa) and a response speed of 20 ms.

The air tank 115 has a capacity of 0.05 $m^3$.

The compressor 116 is a reciprocal oil free type compressor with a power supply of 0.75 kW, a static pressure of 0.8 MPa and an air volume of 0.00125 $m^3/s$.

In the image forming apparatus of FIG. 1 having the aforementioned structure, the sheet feed sensor 102 detects that the recording sheet P stored in the sheet feed cassette 20 has been conveyed by the sheet feed unit 21. The time from the conveyance of the recording sheet P having been detected by the sheet feed sensor 102 to passing through the nip portion N is constant and is known in advance. When the control unit 101 including the CPU has identified arrival of the time sensed by the timer 103, the control unit 101 sends the ON-signal to the electromagnetic valve 114. Then the control unit 101 sends the OFF-signal 50 ms later. The air tank 115 is filled with the compressed air compressed by the compressor 116 in advance. With the opening of the electromagnetic valve 114, compressed air is jetted by the first air nozzle 111, and is blown on the leading edge of the recording sheet P immediately after having passed through the nip portion N.

A signal which indicates the position of the leading edge of the recording sheet P with necessary accuracy such as a sheet feeding signal from the sheet feed cassette 20 or sheet feed timing signal indicating a timing of sheet feed from the registration roller 23 to the transfer, can be used as a detection signal of the leading edge of the recording sheet P to determine a timing to send an open signal and a close signal to the electromagnetic valve 114.

In this case, the compressed air of about 0.8 MPa stored in the air tank 115 by the compressor 116 is depressurized by the regulator (not illustrated) arranged between the air tank 115 and first air nozzle 111, and is supplied to the first air nozzle 111. For example, jetting pressure from the first air nozzle 111 is 0.1 through 0.2 MPa, the jetted air velocity is 100 through 160 m/s, and the jetted air volume is in the range from 0.005 through 0.008 $m^3/s$.

The electromagnetic valve 114 is fully opened about 20 ms after the ON-signal has been inputted. The maximum air volume is reached when the recording sheet P has been fed about 10 mm from the nip portion. The maximum volume of the compressed air jetted from the first air nozzle 111 is 2 through 3 times the air volume required to separate the recording sheet P. Accordingly, the recording sheet P starts separation before the jetted volume of compressed air reaches the maximum level, namely, before the amount of feed from the nip portion N reaches 10 mm. After that, when the OFF-signal is inputted to the electromagnetic valve 114, there is a gradual decrease in the volume of the compressed air jetted from the first air nozzle 111. Air jetting continues until the leading edge of the recording sheet P reaches the point 25 through 30 mm from the nip portion N. The jetted air volume in this case is sufficient to separate the recording sheet P even if there is a toner image with the maximum amount of adherence.

In FIG. 3, three first air nozzles 111*b* arranged inside are connected to the electromagnetic valve 114*a* through the piping section 113*a*. Two first air nozzles 111*c* arranged outside are connected to the electromagnetic valve 114*b* through the piping section 113*b*. Further, the width of the three first air nozzles 111*b* corresponds to the short side of an A4-sized sheet, for example. The width of the five first air nozzles 111*b* and 111*c* corresponds to the long side of an A4-sized sheet, for example. Based on the input to the operation panel arranged on the upper portion of the image reading device, the recording sheet detection unit 104 detects the size of the recording sheet wherein an image is to be formed. This information is sent to the control unit 101.

When an A4-sized recording sheet is fed in the landscape configuration, the control unit 101 allows the ON-signal to be sent to both the electromagnetic valve 114*a* and electromagnetic valve 114*b*. However, when the A4-sized recording sheet is fed in the portrait direction, the control unit 101 allows the ON-signal to be sent only to the electromagnetic valve 114*a*, not to the electromagnetic valve 114*b*. This arrangement reduces the waste of compressed air and minimizes the power consumption of the compressor 116.

In this case, in the halogen heater incorporated in the heating roller, power is sent only to the area corresponding to the area wherein sheets pass, so that power is saved.

As described above, compressed air is jetted from the first air nozzle 111, the leading edge of the recording sheet P having passed through the nip portion N is separated from the fixing belt 81. After that, jetting of the compressed air is suspended. Instead, air sent by a fan from the second air nozzle 121 is blown on a continuous basis to ensure that recording sheet P will not stick to the fixing belt 81.

Referring to FIGS. 4 and 5, the following describes the structure of the second air nozzle 121 and related components.

In FIG. 4, five the second air nozzles 121 are installed across the recording sheet P. The dimensions of the opening of each of the second air nozzles 121 are 65 mm across the recording sheet P and 3 mm along the thickness of the recording sheet P. The openings of the second air nozzles 121 function as outlets of the second jetting unit.

A fan 123 as an air supply unit is arranged in the duct 122 as shown in FIG. 2, and five second air nozzles 121 are connected to relevant parts.

These five fans 123 are 70 mm-axial flow fans having a power supply of 12 W and a static pressure of 500 Pa.

In the image forming apparatus of FIG. 1 having the aforementioned structure, when the sheet feed sensor 102 has detected that the recording sheet P stored in the sheet feed cassette 20 is fed by the sheet feed unit 21, the control unit 101 supplies power to the fan switch 124. This allows each fan 123 to rotate. Air is jetted, for example, at 20 m/s from the second air nozzle 121 and is blown on the recording sheet P so that the recording sheet P is separated from the fixing belt 81. When recording sheets P are fixed on a continuous basis, the fan 123 is kept operating. When the fan 123 has a high degree of responsivity as will be described later, on/off operations can be repeated in conformance to the entry of the recording sheet P.

Before the recording sheet P reaches the fixing device 8, the power is supplied to the fan switch 124. This is because there is a time lag between the moment when power is supplied to the fan 123, and the moment when the maximum speed is reached. If the conveying speed of the recording sheet P is smaller and the fan 123 is capable of reaching the air velocity sufficient to continue separation as will be described later before the recording sheet P reaches the position wherein an attempt is made to separate the recording sheet, then the operation can be started after the recording sheet P has reached the fixing device. Conversely, when the present invention is applied to a high-speed image forming apparatus or a high-output blower requiring a longer start-up time is used as a fan 123, the appropriate start-up timing of the fan 123 must be selected in such a way that, for example, a blower is started before the sheet feed operation of the image forming apparatus starts or the operation of the image forming apparatus starts.

The pressure of air jetted from the second air nozzle 121 is 400 Pa, the jetting air velocity is 20 through 30 m/s, and the jetted air volume is 0.025 through 0.04 $m^3/s$.

The fan 123 is not restricted to the axial flow type fan. A sirocco fan, cross-flow fan or blower can be used if the air volume thereof is sufficient to separate on a continuous basis the recording sheets P whose leading edges have been separated from the fixing belt 81. The shape of the duct 122 is determined by the type of the fan 123.

In FIG. 4, five second air nozzles 121 are provided across the recording sheet P. Similarly to the case of the first air nozzle 111, the width of the three first air nozzles 121*a* arranged inside corresponds to the short side of an A4-sized sheet, for example. The width of three second air nozzles 121*a* and two second air nozzles 121*b* arranged outside corresponds to the long side of an A4-sized sheet, for example. The three second air nozzles 121*a* communicate with three fans 123, and two second air nozzles 121*b* communicate with two fans 123, respectively. When the A4-sized recording sheet is conveyed in the landscape configuration, the control unit 101 allows power to be supplied to both the fan switch 124 corresponding to the second air nozzle 211*a* and the fan switch 124 corresponding to the second air nozzle 211*b* located outside. However, when the A4-sized recording sheet is fed in the portrait configuration, the control unit 101 allows power to be sent only to the fan switch 124 corresponding to the second air nozzle 211*a*. This arrangement minimizes unwanted rotation of the fan 123 and cooling of the fixing member by the air for separation, whereby power consumption of the fan 123 and halogen heater 82A is reduced.

The air volume and other related factors given in the Explanation of the present Application assumes the case of separating the recording sheet having a width equivalent to the longer side of an A4-sized sheet of paper. When the width for jetting is to be changed according to the width of a recording sheet, the air volume must also be changed accordingly.

A test was conducted to feed A4-sized recording sheets P at 100 ppm using the image forming apparatus equipped with a fixing device 8 having the first air nozzle 111 and the second air nozzle 121 described above.

According to the test, it has been revealed that, when the leading edge of the recording sheet P is fed about 10 mm from the nip portion N, continuous separation of sheets can be achieved if air is sent at a jetting air velocity of about 20 m/s and a jetting air volume of about 0.02 $m^3/s$, even if these sheets are thin coated sheets for printing having a thickness of about 80 $g/m^2$ wherein the solid image containing the maximum amount of adherence has been transferred.

The second air nozzle 121 is arranged to ensure that the air jetted from the second air nozzle 121 will reach the point about 10 mm from the outlet of the nip portion N and a powerful flow will be formed to separate the recording sheet P completely.

The leading edge of the recording sheet P is separated from the fixing belt 81 by the air jetted from the first air nozzle, and the recording sheet P is separated by receiving the air jetted from the second air nozzle 121. Until the sufficient force to achieve this process is obtained, the jetting of air from first air nozzle 111 must be continued. Both jetting of air from the first air nozzle 111 and jetting from the second air nozzle 121 are performed until the leading edge of the recording sheet P is fed about 10 mm from the outlet side of the nip portion N. After that, when the leading edge of the recording sheet P is apart from the outlet of the nip portion N by 10 mm or more, the recording sheet P can be completely separated from the fixing belt 81 by the air jetted from the second air nozzle 121, even if there is no jetting from the first air nozzle 111.

The test has also revealed that, if the recording sheet P is separated after the leading edge of the recording sheet P has wound around the fixing belt 81 by 10 mm or more, irregularities occur to the image the and the image quality is deteriorated for the reasons considered to have been caused by changes in the time of contact between the recording sheet P and fixing belt 81 or changes in the state of separation. Especially when the leading edge of the sheet has wound around the belt by 15 mm or more, the irregularities of the image cannot be ignored. However, the arrangement described above ensures that the separation process starts before this amount of winding is reached, so that there will be no image irregularities at all, or image irregularities, if any, will be kept within a tolerable range.

The jetting of air from the first air nozzle 111 must be applied between the leading edge of the recording sheet P floating only a short distance over the fixing belt 81, and the fixing belt 81, so that the leading edge of the recording sheet P can be held upward. This requires a high degree of air velocity. However, the total jetting air volume is kept low because a high degree of air velocity is required only for a short period of time. For example, when the margin at the leading edge of paper measures about 3 mm using the roller configuration of this Example, the leading edge of the recording sheet P floats by only 0.1 mm. In the meantime, for the jetting from the second air nozzle 121, the leading edge of the recording sheet P floats, and the area for receiving air is increased, and a high air velocity is not required. However, air is jetted on a continuous basis until all the recording sheets P have passed through the nip portion N. This will require a high air volume to be jetted in total. However, air is supplied to the second air nozzle 121 using a fan characterized by an increased sectional area for air jetting despite a low pressure. This allows a great volume of air to be jetted. The power required for a compressor is determined by the total volume of air to be jetted. In the present invention, air is jetted on an intermittent basis and the jetted air volume in one operation is reduced. This arrangement permits compressed air to be supplied by a low-power compressor. As described above, the mutually compensatory configuration between the first air nozzle 111 and second air nozzle 121 reduces the size and power consumption to about one tenth, as compared with the structure wherein all the required air is jetted from the first air nozzle 111 alone without a second air nozzle 121 being provided.

In the aforementioned structure, the first air nozzle 111 and the second air nozzle 121 have been described as being divided into five pieces, without the present invention being restricted to this quantity. Each of the first air nozzle 111 and the second air nozzle 121 can be designed in an integral unit, wherein the internal flow path is divided. The proper quantity can be selected in conformity to varying dimensions of the recording sheet P and the light distribution of the halogen heater 82A.

The fixing device using the first air nozzle 111 and the second air nozzle 121 is not restricted to the aforementioned belt fixing device. A hearting roller fixing device consisting of a fixing roller (fixing member) and pressure roller (pressure member) can also be utilized. If a fixing device is capable of separating a recording sheet after the sheet has been brought in close contact with the fixing member, the advantages of the present invention can be achieved by proper selection of the configuration requirements of the present invention.

Louvers are provided on the front and back of the image forming apparatus as shown in FIG. 1. The outside air sucked from the opening of the louver is lead to the fan 123 located on the outlet of the fixing device through the air duct arranged on the top of the fixing device. This air duct is kept at a low temperature by outside air and suppresses the temperature rise in the toner storage section caused by the spread of heat from the fixing device.

The air jetted from the first air nozzle 111 and second air nozzle 121 is led to the opening provided at the end of the image forming apparatus on the outlet side of the fixing device by the duct wherein part of the recording sheet conveyance guide is used as a wall. The air is then ejected outside. If this opening is provided with an exhaust fan, more effective air exhaustion will be ensured. This arrangement also minimizes the thermal pollution inside the apparatus caused by the heated air blown onto the fixing device. When the image forming apparatus is connected with a finishing apparatus or others, the top surface or back surface of the image forming apparatus should be provided with an opening for exhaustion.

In the present embodiment, toner containing wax is used. The wax oozes out of the nip to the toner layer surface, and serves as a releasing agent. After coming out of the fixing nip, the wax is cooled. The wax has a lower melting point than a binder resin, and solidifies slowly as compared to the binder that is solidified immediately after ejection from the nip. Solidification may require several seconds after coming out of the nip, depending on the temperature conditions. If the wax comes in contact with the roller and guide, ribs and members after the fixing nip, only the portion in contact will be solidified earlier. If the wax is brought in contact with a member heated by the sheet whose temperature has been raised after fixing, that portion will be solidified slowly. The wax exhibits different states of crystallization according to the temperature reduction speed at the time of solidification (phase transfer). This appears as differences in gloss on the image.

In the present embodiment, air for separation is blown between the fixing member and recording sheet. At room temperature or a temperature slightly higher than room temperature, high-speed air is blown on the toner layer immediately after coming out of the fixing nip. This causes an abrupt reduction in the temperature of the toner layer. This encourages solidification of the wax, and provides the advantage of reducing the aforementioned differences in gloss. This effect is conspicuous when the toner containing wax for separation is utilized.

What is claimed is:

1. A fixing device comprising:

a fixing member;

a pressing member to form a nip portion between the pressing member and the fixing member, wherein the fixing member and the pressing member sandwich a recording medium, fix a toner image on the recording medium and convey the recording medium;

a detection unit for detecting that a leading edge of the recording medium is located at the nip portion;

a first air jetting unit for separating the recording medium from the fixing member by jetting air only to a position close to the leading edge of the recording medium having passed the nip portion based on the detection result by the detection unit; and a second jetting unit for jetting air to the recording medium whose leading edge has passed through the nip portion;

wherein the air supply unit for the first air jetting unit is an air compressor, and an air supply unit for the second air jetting unit is a fan or blower.

2. The fixing device of claim 1, wherein a velocity of air jetted from the first air jetting unit is greater than a velocity of air jetted from the second air jetting unit.

3. The fixing device of claim 1, wherein a sectional area of outlets of the first air jetting unit is smaller than that of the second air jetting unit.

4. The fixing device of claim 1, wherein an electromagnetic valve is provided between an air supply unit for the first air jetting unit and the first air jetting unit.

5. The fixing device of claim 1, wherein a plurality of first air jetting units and a plurality of second air jetting units are arranged along a width of the recording medium to be fixed; and the fixing device is provided with a control unit wherein, when fixing the recording medium narrower than the widest recording medium that can be fixed, control is provided in such a way as to suspend a jetting of air from the first and second air jetting units which are located at an end along the recording medium and which do not contribute to separation of the recording medium.

6. The fixing device of claim 5, further comprising a plurality of electromagnetic valves communicating with the first air jetting units respectively, and a plurality of fan switches or blower switches communicating with the second air jetting units, wherein the control unit controls on-off operations of the electromagnetic valves and fan switches.

7. An image forming apparatus comprising:

an image forming section for forming a toner image;

a transfer section for transferring the toner image onto a recording medium; and a fixing device for fixing the toner image on the recording medium, wherein the fixing device includes:

a fixing member;

a pressing member to form a nip portion between the pressing member and the fixing member, wherein the fixing member and the pressing member sandwich the recording medium, fix the toner image on the recording medium and convey the recording medium;

a detection unit for detecting that a leading edge of the recording medium is located at the nip portion;

a first air jetting unit for separating the recording medium from the fixing member by jetting air only to a position close to the leading edge of the recording medium having passed the nip portion based on the detection result by the detection unit; and a second jetting unit for jetting air to the recording medium whose leading edge has passed through the nip portion;

wherein the air supply unit for the first air jetting unit is an air compressor, and an air supply unit for the second air jetting unit is a fan or blower.

8. The image forming apparatus of claim 7, wherein a velocity of air jetted from the first air jetting unit is greater than a velocity of air jetted from the second air jetting unit.

9. The image forming apparatus of claim 7, wherein a sectional area of outlets of the first air jetting unit is smaller than that of the second air jetting unit.

10. The image forming apparatus of claim 7, wherein an electromagnetic valve is provided between an air supply unit for the first air jetting unit and the first air jetting unit.

11. The image forming apparatus of claim 7, wherein a plurality of first air jetting units and a plurality of second air jetting units are arranged along a width of the recording medium to be fixed; and the fixing device is provided with a control unit wherein, when fixing the recording medium narrower than the widest recording medium that can be fixed, control is provided in such a way as to suspend a jetting of air from the first and second air jetting units which are located at an end across the recording medium and which do not contribute to separation of the recording medium.

12. The image forming apparatus of claim 11, further comprising a plurality of electromagnetic valves communicating with the first air jetting units respectively, and a plurality of fan switches or blower switches communicating with the second air jetting units, wherein the control unit controls on-off operations of the electromagnetic valves and fan switches.

13. A fixing device comprising:

a fixing member;

a pressing member to form a nip portion between the pressing member and the fixing member, wherein the fixing member and the pressing member sandwich a recording medium, fix a toner image on the recording medium and convey the recording medium;

a first air jetting unit for separating the recording medium from the fixing member by jetting air continuously to a position close to a leading edge of the recording medium having passed the nip portion; and a second jetting unit for separating the recording medium from the fixing member by jetting air to the recording medium whose leading edge has passed through the nip portion, wherein a velocity of air jetted from the first air jetting unit is greater than a velocity of air jetted from the second air jetting unit; and wherein a plurality of first air jetting units and a plurality of second air jetting units are arranged across a width of the recording medium to be fixed; and the fixing device is provided with a control unit wherein, when fixing the recording medium narrower than the widest recording medium that can be fixed, control is provided in such a way as to suspend a jetting of air from the first and second air jetting units which are located at an end across the recording medium and which do not contribute to separation of the recording medium.

14. The fixing device of claim 13, wherein a sectional area of outlets of the first air jetting unit is smaller than that of the second air jetting unit.

15. An image forming apparatus comprising:

an image forming section for forming a toner image;

a transfer section for transferring the toner image onto a recording medium; and a fixing device for fixing the toner image on the recording medium;

wherein the fixing device comprises:

a fixing member;

a pressing member to form a nip portion between the pressing member and the fixing member, wherein the fixing member and the pressing member sandwich a recording medium, fix a toner image on the recording medium and convey the recording medium;

a first air jetting unit for separating the recording medium from the fixing member by jetting air continuously to a position close to a leading edge of the recording medium having passed the nip portion; and a second jetting unit for separating the recording medium from the fixing member by jetting air to the recording medium whose leading edge has passed through the nip portion, wherein a velocity of air jetted from the first air jetting unit is greater than a velocity of air jetted from the second air jetting unit; and wherein a plurality of first air jetting units and a plurality of second air jetting units are arranged along a width of the recording medium to be fixed; and the fixing device is provided with a control unit wherein, when fixing the recording medium narrower than the widest recording medium that can be fixed, control is provided in such a way as to suspend a jetting of air from the first and second air jetting units which are located at the end across the recording medium and which do not contribute to separation of the recording medium.

16. The image forming apparatus of claim 15, wherein a sectional area of the first air jetting unit is smaller than that of the second air jetting unit.

* * * * *